US011322824B2

(12) United States Patent
Yang et al.

(10) Patent No.: US 11,322,824 B2
(45) Date of Patent: May 3, 2022

(54) ANTENNA ASSEMBLY AND WIRELESS TERMINAL

(71) Applicant: BOE Technology Group Co., Ltd., Beijing (CN)

(72) Inventors: Jun Yang, Beijing (CN); Tao Li, Beijing (CN)

(73) Assignee: BOE Technology Group Co., LTD., Beijing (CN)

( * ) Notice: Subject to any disclaimer, the term of this patent is extended or adjusted under 35 U.S.C. 154(b) by 56 days.

(21) Appl. No.: 16/893,461

(22) Filed: Jun. 5, 2020

(65) Prior Publication Data

US 2021/0126342 A1 Apr. 29, 2021

(30) Foreign Application Priority Data

Oct. 29, 2019 (CN) ..... 201921831154.X

(51) Int. Cl.
*H01Q 1/24* (2006.01)
*H01Q 1/48* (2006.01)

(52) U.S. Cl.
CPC ..... *H01Q 1/24* (2013.01); *H01Q 1/48* (2013.01)

(58) Field of Classification Search
CPC ..... H01Q 1/24; H01Q 1/48
See application file for complete search history.

(56) References Cited

U.S. PATENT DOCUMENTS 8,861,198 B1 * 10/2014 Asuncion ..... G06F 1/1658 361/679.55
2006/0238430 A1 * 10/2006 Morioka ..... H01Q 7/04 343/742
2010/0271283 A1 * 10/2010 Sung ..... H01Q 1/38 343/906
2014/0078008 A1 * 3/2014 Kang ..... H01Q 1/38 343/702
2020/0343643 A1 * 10/2020 Zhang ..... H01Q 11/14

* cited by examiner

*Primary Examiner* — Hai V Tran
(74) *Attorney, Agent, or Firm* — Fay Sharpe LLP

(57) ABSTRACT

Disclosed are an antenna assembly and a wireless terminal. The antenna assembly includes: a metal frame, wherein a first partition gap and a second partition gap are spacedly arranged on the metal frame, and the metal frame positioned between the first partition gap and the second partition gap forms a first radiator; and a radio frequency module, wherein the radio frequency module is coupled to the first radiator by a radio frequency signal feeder, wherein the metal frame between the first partition gap and the second partition gap is provided with a first ground point.

20 Claims, 3 Drawing Sheets

ANTENNA ASSEMBLY AND WIRELESS TERMINAL

TECHNICAL FIELD

The present disclosure relates to an antenna assembly and a wireless terminal.

BACKGROUND

The antenna is a device for transmitting or receiving electromagnetic wave in wireless devices. Currently, the antennae arranged in the wireless terminals may be categorized into an external antenna and a built-in antenna.

SUMMARY

Embodiments of the present disclosure provide an antenna assembly and a wireless terminal.

In one aspect, embodiments of the present disclosure provide an antenna assembly. The antenna assembly includes:

a metal frame, wherein a first partition gap and a second partition gap are spacedly arranged on the metal frame, and the metal frame positioned between the first partition gap and the second partition gap forms a first radiator; a radio frequency module, wherein the radio frequency module is coupled to the first radiator by a radio frequency signal feeder; the metal frame between the first partition gap and the second partition gap is provided with a first ground point.

Optionally, the first ground point and the radio frequency signal feeder are separated by a first preset distance.

Optionally, the first partition gap and the second partition gap are both filled with an insulating material.

Optionally, the antenna assembly further includes: a second radiator, wherein the first radiator is coupled to the radio frequency signal feeder by the second radiator.

Optionally, a width range of the second radiator is 1 mm to 2 mm.

In another aspect, embodiments of the present disclosure provide an antenna assembly. The antenna assembly includes: the above antenna assembly; a display assembly; a support frame, wherein an accommodating space is formed in the support frame and configured to mount the display assembly, and the metal frame is coupled to a first frame of the support frame; and a processor, configured to acquire a display content by the antenna assembly and controlling the display assembly to display the display content.

Optionally, the support frame includes a metal support frame and a plastic support frame which are integrally molded, wherein the plastic support frame is configured to support the display assembly.

Optionally, the support frame is manufactured by a nanometer injection molding process.

Optionally, a second ground point is arranged on the first frame and coupled to the first ground point by a ground wire.

Optionally, a circuit board is arranged in the accommodating space, and the processor and the radio frequency module are both arranged on the circuit board; and the metal support frame is coupled to a third ground point of the circuit board by a conductive material.

Optionally, the conductive material is a conductive sponge.

Optionally, the display assembly includes a first display screen and a second display screen which are opposite to each other;

wherein the circuit board is arranged between the first display screen and the second display screen.

Optionally, a metal protective layer is arranged between the first display screen and the second display screen, and coupled to both the third ground point of the circuit board and the conductive material.

Optionally, the metal protective layer and the metal support frame are coupled by a plurality of conductive materials, and the plurality of conductive materials are spacedly arranged.

Optionally, the metal frame is semicircular, and the metal frame and the support frame are integrally molded.

Optionally, a minimum distance between the first radiator and the first frame of the support frame is greater than 5 mm.

Optionally, the metal frame and the support frame form a hanging ring.

DETAILED DESCRIPTION

For further illustration of the technical methods and effects for achieving the intended object according to the present disclosure, the implementations, structures, features and effects of an antenna assembly and a wireless terminal according to the present disclosure are described below in detail with reference to the accompanying drawings and examples.

An external antenna mainly includes a whip-shaped antenna, a spiral antenna, or the like, which are fixedly arranged outside the wireless terminal, thus having the defects of inconvenience in use and storage, large occupied space, susceptibility to damage, or the like. For the sake of addressing the defects of the external antenna, the built-in antenna arranged in the wireless terminal is mainly used. However, during application of some wireless terminals with display functions, the antenna assembly is mostly arranged on a rear side of a display region of a display screen, which is liable to cause interference normal display of the display screen to cause flicker and affects the performance of the antenna.

At present, in some public places, wireless terminal devices with display functions are often set up to display advertisement and other contents. By the antenna structure, functions of receiving and transmitting electromagnetic wave by the wireless terminal may be achieved, the display content of the wireless terminal may be acquired, and the display content may be conveniently controlled. For example, currently, hanging ring handrails used in subways, buses, or the like may be set as wireless terminals with display functions, such that the hanging ring handrails may display announcement information, broadcast, advertisement, and other contents, the functions of the hanging ring handrails may be achieved, and the functionality and the practicability of the hanging ring handrails are enhanced. Arranging the external antenna on the wireless terminal such as the hanging ring handrail may bring the problems of inconvenience in use, attractiveness influence and susceptibility to damage, while using the built-in antenna may cause interference to display of the display screen and affect the display effect of the display screen and the performance of the antenna.

Figure 1:
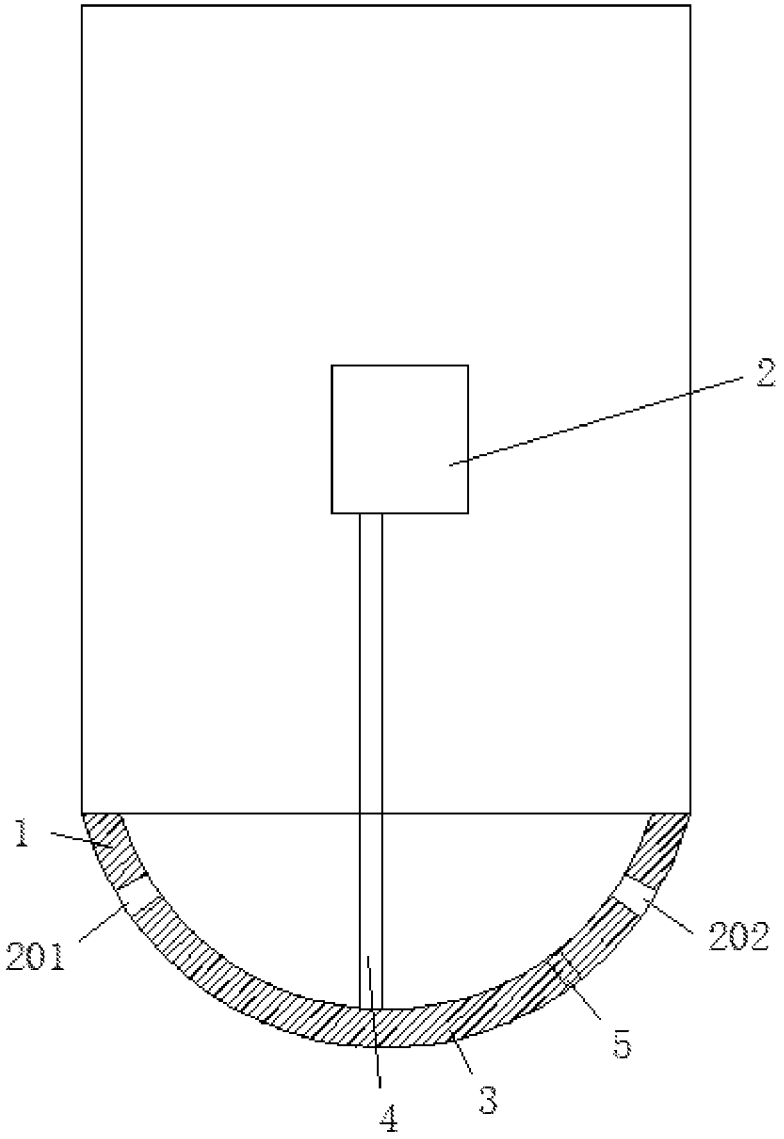
FIG. 1 is a schematic structural diagram of an antenna according to an embodiment of the present disclosure.
Figure 2:
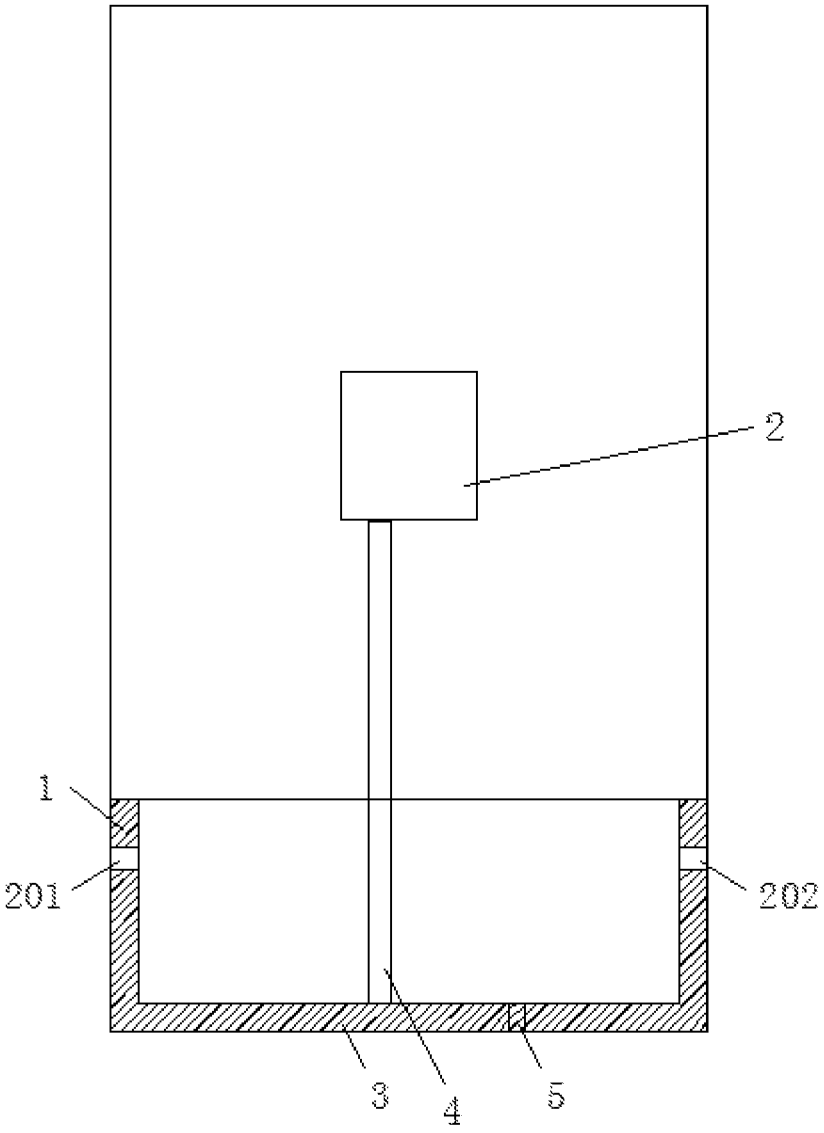
FIG. 2 is a schematic structural diagram of another antenna assembly according to an embodiment of the present disclosure.

In order to solve the above problems, as shown in FIG. 1 to FIG. 2, an embodiment of the present disclosure provides an antenna assembly. The antenna assembly includes:

a metal frame 1, wherein a first partition gap 201 and a second partition gap 202 are spacedly arranged on the metal frame 1, and the metal frame 1 positioned between the first partition gap and the second partition gap forms a first radiator 3; a radio frequency module 2, wherein the radio frequency module 2 is coupled to the first radiator 3 by a radio frequency signal feeder 4; wherein the metal frame 1 between the first partition gap 201 and the second partition gap 202 is provided with a first ground point 5.

The metal frame 1 is made of a metal material. The metal frame 1 may be a section of frame arranged outside the wireless terminal, for example, the metal frame 1 may be set as a frame with an opening part configured to be coupled to the wireless terminal, for example, the opening part may be coupled to a frame outside the wireless terminal, the metal frame 1 herein may be set to be rectangular, semicircular, or the like, or the metal frame 1 may further be a frame of one section of the metal material forming an externally closed frame structure of the wireless terminal. Radio frequency penetration of the antenna cannot be realized only by the metal frame 1, therefore, the first partition gap 201 and the second partition gap 202 are spacedly arranged on the metal frame 1, and the metal frame 1 positioned on a part between the first partition gap 201 and the second partition gap 202 may form the first radiator 3 which is a radiation unit of the antenna assembly. The first partition gap 201 and the second partition gap 202 may be symmetrically arranged on two sides of the metal frame 1, and may further be asymmetrically arranged. The first radiator 3 is coupled to a radio frequency module by the radio frequency signal feeder 4, and the first radiator 3 and the radio frequency module jointly from the antenna assembly. a length of the metal frame 1 positioned in the part between the first partition gap 201 and the second partition gap 202 is an effective length of the antenna assembly, and a length of the antenna should be a half-wavelength of an operating frequency band. According to the actual condition of the operating frequency band of the wireless terminal, requirements of the operating frequency band may be met by adjusting positions of the first partition gap 201 and the second partition gap 202, for example, if the half-wavelength of a 900-MHz frequency band is 166 mm and the half-wavelength of a 400-MHz frequency band is 375 mm, a space between the first partition gap 201 and the second partition gap 202 at the 400-MHz frequency band should be increased, that is, according to FIG. 1 and FIG. 2, a gap between the first partition gap 201 and the second partition gap 202 should be increased by adjusting positions of the first partition gap 201 and the second partition gap 202 towards an upper side, and the effective length of the antenna is increased, thereby meeting requirements of frequency bands.

When the antenna assembly is applied to the wireless terminal, the radio frequency module may be arranged in the wireless terminal and may be arranged on a circuit board of the wireless terminal, while only the radiation unit, namely the first radiator 3, of the antenna assembly is arranged outside the wireless terminal, or on an edge of a side of a frame of the wireless terminal.

The first ground point 5 is arranged on the metal frame between the first partition gap 201 and the second partition gap 202, that is, the first ground point 5 is arranged on the first radiator 3 and configured to be coupled to a ground wire, such that the wavelength of the frequency band may be adjusted, the wavelength of the operating frequency band may be shortened, the setting length of the antenna assembly may be shortened and, the occupied space of the antenna assembly may be reduced.

Optionally, the first ground point 5 and the radio frequency signal feeder 4 are separated by a first preset distance. That is, it is necessary to separate a position of the first ground point 5 from the radio frequency signal feeder 4 by a first preset distance which may be more than 2 mm, such that influence on the performance of the antenna by interference may be avoided.

The embodiment I of the present disclosure provides an antenna assembly. A first partition gap and a second partition gap are spacedly arranged on the metal frame 1, such that the metal frame achieves radio frequency transmission of the antenna, the metal frame 1 between the first partition gap and the second partition gap forms a first radiator of the antenna assembly, and the first radiator and a radio frequency module jointly form the antenna assembly. The metal frame may be arranged outside the wireless terminal or may serve as a section of frame outside the wireless terminal, which may solve the problem of causing interference to structures such as a display assembly or the like in the wireless terminal, and may ensure the performance of the antenna assembly. Furthermore, if the metal frame is arranged outside the wireless terminal, the metal frame may be fixed to an outer frame of the wireless terminal to be an integrated structure, which is difficult from a form of an existing external antenna, thereby reducing occupied space and solving the problem of susceptibility to damage.

Further, the first partition gap 201 and the second partition gap 202 may be both filled with an insulating material, and the metal frame 1 forms a complete structure after middle parts of the first partition gap 201 and the second partition gap 202 are filled, such that beautiful appearance of the metal frame 1 is improved; and for example, the insulating material may be plastic, but not limited that, which is not limited herein.

Further, when the antenna assembly according to the embodiment is applied to the wireless terminal, the antenna assembly may further be provided with a second radiator 6 which is coupled between the first radiator 3 and the radio frequency signal feeder 4, thereby ensuring beautiful appearance and enabling the metal frame 1 not to occupy too large space. The second radiator 6 may increase the effective length of the antenna. After the second radiator 6 is arranged, the first radiator 3 is a main radiator, and the effectiveness length of the antenna is a sum of a length of the first radiator 3 and a length of the second radiator 6, that is, the sum of the length of the first radiator 3 and the length of the second radiator 6 should be a half-wavelength of an operating frequency band. When the antenna assembly is applied to the wireless terminal, for the sake of not increasing an entire setting size of the antenna assembly and the wireless terminal, the length of the antenna may be increased by adding the second radiator 6 when the length of the first radiator 3 may not meet the requirement of the frequency band, and the second radiator 6 may be arranged on a region surrounded by the first radiator 3 and the wireless terminal, thereby preventing the second radiator 6 from increasing the occupied space. Further, the second radiator 6 also may improve connection convenience of the first radiator 3 and the radio frequency signal feeder 4. Since the first radiator 3 is a part of the metal frame 1 and a mounting point is not coupled to the radio frequency signal feeder 4, the first radiator 3 may be welded to the radio frequency signal feeder 4, for example, the second radiator 6 may be a metal sheet provided with a mounting hole, thereby facilitating connection of the second radiator 6, the first radiator 3 and the radio frequency signal feeder 4. For example, a length of the second radiator may be set according to the setting condition; a shape of the second radiator 6 may be a long strip, but not limited to this, which is not limited herein; and a width of the second radiator may be 1 mm to 2 mm.

For example, the second radiator may be made of a metal material. For example, the second radiator may be made of a material the same as that of the metal frame.

For example, the radio frequency signal feeder 4 may be a shielding wire, and the shielding wire has high shielding property, thereby avoiding interference to display of a screen by signal leakage. In addition, a metal shielding layer of the shielding wire may be grounded, thereby ensuring signal integrity.

Figure 3:
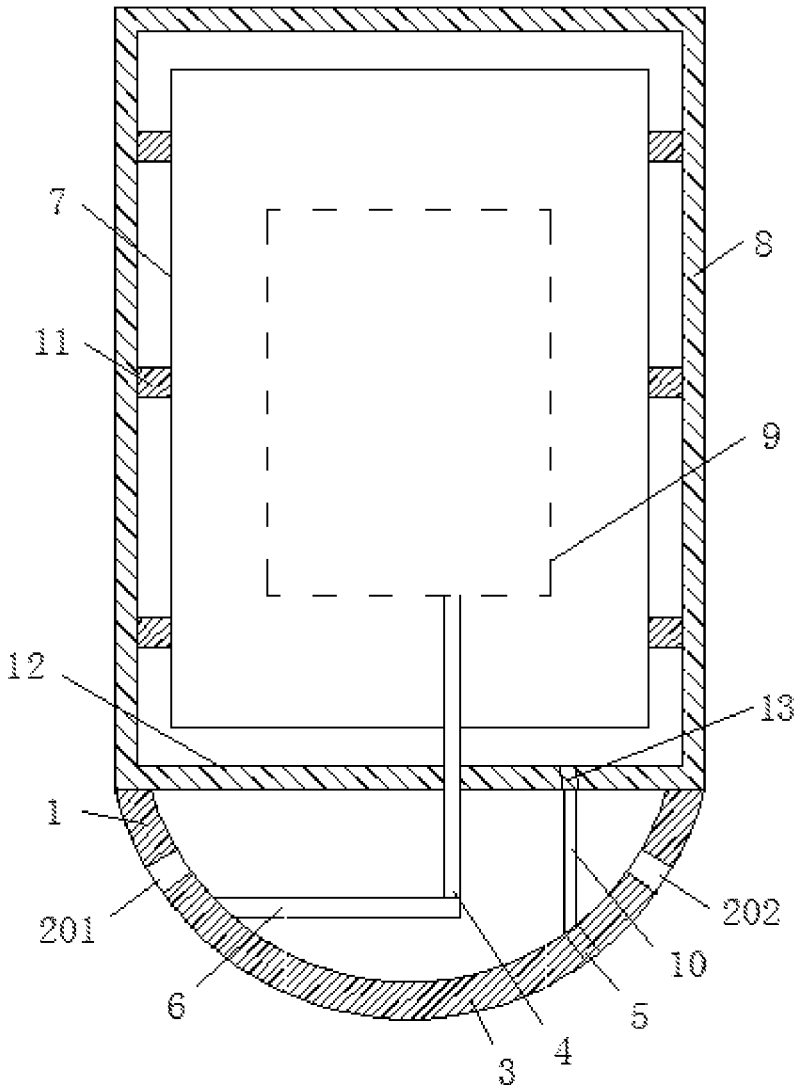
FIG. 3 is a schematic structural diagram of a wireless terminal according to an embodiment of the present disclosure.

As shown in FIG. 3, another embodiment of the present disclosure provides a wireless terminal. The wireless terminal includes:

the above antenna assembly; a display assembly 7; a support frame 8, wherein an accommodating space is formed in the support frame 8 and configured to mount the display assembly 7, and the metal frame 1 is coupled to a first frame of the support frame 8; a processor, configured to acquire a display content by the antenna assembly and controlling the display assembly to display the display content; and a power supply unit, configured to provide electric energy to the display assembly, the processor, or the like; wherein a circuit board 9 is arranged in the accommodating space, and the processor, the power supply unit, and the radio frequency module are both arranged on the circuit board 9.

The wireless terminal may be an electronic device with a display function, which may be a non-mobile terminal applied in public places; and the display function is realized by the display assembly 7. The wireless terminal further includes the support frame 8, wherein the display assembly 7 is arranged in the accommodating space formed in the support frame 8; the support frame 8 achieves effects of fixing and supporting the display assembly 7; a shape of the support frame 8 may be rectangle; and a material of the support frame 8 may be metal and may further be a non-metal material. The metal frame 1 of the antenna assembly is coupled to the first frame of the support frame 8; the first radiator 3 may serve as an antenna radiation unit of the wireless terminal; the circuit board 9 may be arranged in the accommodating space formed in the support frame; the circuit board 9 may be arranged on a rear side of the display assembly 7, that is, on a non-luminous side of the display assembly 7; the radio frequency module of the antenna assembly may be arranged on the circuit board 9; the circuit board 9 may further include the processor and the power supply unit; the processor may acquire a display content of the display assembly 7 by the antenna assembly and control the display content of the display assembly 7; and the power supply unit may provide an operating power supply for the processor and the display assembly 7.

The metal frame 1 of the antenna assembly is arranged on a first side of the support frame, and coupled to the first frame of the support frame 8. For example, as shown in FIG. 3, the metal frame 1 may be arranged on a lower side of the support frame 8, the first frame is a lower side frame of the support frame 8, a hanging ring handrail with a display function may be formed, the first frame may be semicircular and is arranged on a lower side of the wireless terminal to serve as a handle part, and an insulating layer may be arranged outside the first frame during use. The first radiator 3 of the first frame is arranged outside the wireless terminal relative to the display assembly 7, such that the problem of causing interference to the display assembly 7 may be solved and the display effect of the display assembly 7 may be improved; and furthermore, the first frame may serve as the handle part of the hanging ring handrail and may also serve as the antenna radiation unit of the wireless terminal, thereby reducing the occupied space, solving the problem of susceptibility to damage, and having high practicability compared with the existing external antenna.

The embodiment of the present disclosure provides a wireless terminal. The metal frame 1 of the antenna assembly is coupled to the first frame of the support frame 8, and the first radiator 3 of the first frame is arranged outside the wireless terminal relative to the display assembly 7, such that the problem of causing interference to the display assembly 7 may be solved; and furthermore, compared with the existing external antenna, the first frame reduces the occupied space of the antenna, addresses susceptibility to damage, and achieves high practicability.

For example, the support frame 8 includes a metal support frame and a plastic support frame which are integrally molded, wherein the plastic support frame 8 is configured to support the display assembly 7.

Optionally, the support frame may be manufactured by a nanometer injection molding process, wherein the nanometer injection molding process is a process of combining metal and plastic by a nanometer technology, that is, plastic is directly injected and molded on a surface of metal after the surface of the metal is subjected to nanometer treatment, and a position of the plastic may be arranged corresponding to a position of the display assembly, such that the attractiveness of the support frame 8 is improved and a structure of the support frame 8 may be simplified.

Further, a second ground point 13 is arranged on the first frame 12, and coupled to the first ground point 5 by a ground wire 10. Since the support frame 8 includes the metal support frame 8 part and the first ground point 5 is coupled to the second ground point on the first frame by the ground wire 10, the support frame 8 may be grounded, the metal support frame 8 may participate in radiation and serve as a part assisting in radiation, and the antenna radiation area of the wireless terminal may be increased, such that radiation efficiency is improved.

For example, the metal support frame 8 is coupled to the third ground point of the circuit board 9 by a conductive material 11. After the second ground point is coupled to the first ground point 5 by the ground wire, the support frame 8 and the circuit board 9 are grounded in a separating and disconnecting way. In this case, the support frame 8 participates in radiation of the antenna and energy of the support frame 8 may cause coupling interference with the circuit board 9, such that radiation efficiency is reduced; and the metal support frame 8 is coupled to the third ground point of the circuit board 9 by the conductive materials, and the support frame 8 and the circuit board 9 may be grounded integrally and completely, such that radiation efficiency may be improved and influence of ESD may be inhibited. Further, a connection mode of the metal support frame 8 and the circuit board 9 may be: a gap exists between the circuit board 9 and the support frame 8, a metal protective layer is arranged between the circuit board 9 and the display assembly 7, and the conductive materials 11 are arranged in the gaps between an outer edge of the metal protective layer and the support frame 8 uniformly, therefore, the support frame 8 and the circuit board 9 may be grounded integrally, wherein the conductive materials may be a conductive sponge.

For example, the wireless terminal according to the embodiment may be a wireless terminal with double display screens, that is double-surface display may be realized, therefore, the display assembly 7 may include a first display screen and a second display screen arranged opposite to each other, wherein the circuit board 9 is arranged between the first display screen and the second display screen. A controller may control the first display screen and the second display screen simultaneously; and the first display screen and the second display screen may display the same display content, or the first display screen and the second display screen may also display different contents.

For example, a metal protective layer is arranged between the first display screen and the second display screen, and the metal protective layer is coupled to both the third ground point of the circuit board and the conductive material, thereby realizing connection of the support frame and the circuit board.

As shown in FIG. 3, the metal protective layer and the metal support frame are coupled by a plurality of conductive materials, and the plurality of conductive materials are spacedly arranged. Grounding reliability is ensured through connection by the plurality of conductive materials. For example, as shown in FIG. 3, the metal protective layer and the metal support frame are coupled by six pieces of conductive materials. In other implementation manners, the number of conductive materials may be more or fewer as long as the grounding reliability is ensured.

For example, a minimum distance between the first radiator and the first frame of the support frame is greater than 5 mm, thereby avoiding coupling interference between the metal support frame in the support frame and the first radiator.

For example, as shown in FIG. 3, when the wireless terminal according to the embodiment is applied to a hanging ring handrail used in subways, buses, or the like, the metal frame 1 may be set as a semi-annular shape, and the metal frame 1 and the support frame 8 are integrally molded. The semi-annular shape herein may be a semi-ring annular shape, or may further be a semi-rectangle annular shape, which is not limited herein. The metal frame 1 may serve as a handle part, and the metal frame 1 and the support frame 8 are integrally molded, thereby improving strength and practicability. In addition, the first radiator 3 of the metal frame 1 also may serve as an antenna radiation unit of the wireless terminal, therefore, compared with the existing external antenna, occupied space is reduced, and susceptibility to damage is addressed, and high practicability is achieved.

Optionally, the wireless terminal according to the embodiment of the present disclosure may further include a memory, a power supply assembly, a multimedia assembly, an audio assembly, an input/output (I/O) interface, a sensor assembly, a communication assembly, or the like, wherein the memory, the input/output interface, the communication assembly or the like may be integrated on the circuit board.

The memory is configured to store various types of data to support operation of the wireless terminal. Examples of the data include instructions of any application programs or methods operated on the terminal, contact person data, telephone directory data, messages, pictures, videos, or the like. The memory may be implemented by any types of volatile or non-volatile storage devices, or a combination thereof, such as a static random access memory (SRAM), an electrically-erasable programmable read-only memory (EEPROM), an erasable programmable read-only memory (EPROM), a programmable read-only memory (PROM), a read-only memory (ROM), a magnetic memory, a flash memory, a magnetic disk or an optical disk.

The power supply assembly provides power for various assemblies of the wireless terminal. The power supply assembly may include a power supply management system, one or more power supplies, and other assemblies associated with terminal generation, management and power distribution.

The multimedia assembly includes a screen between the wireless terminal and a user and capable of providing an output interface. In some embodiments, the screen may include the display assembly and a touch panel (TP). If the screen includes the touch panel, the screen may be realized as a touch screen to receive an input signal from the user. The touch panel includes one or more touch sensors to sense a touch, a slide and a gesture on the touch panel. The touch sensor may not only sense a boundary of a touch or slide action, but also detect a duration and a pressure related to the touch or slide operation. In some embodiments, the multimedia assembly includes a front camera and/or a rear camera. When the terminal is in an operating mode, such as a shooting mode or a video mode, the front camera and/or the rear camera may receive external multimedia data. Each one of the front camera and the rear camera may be a fixed optical lens system or has a focal length and an optical zoom capability.

The audio assembly is configured to output and/or input an audio signal. For example, the audio assembly includes a microphone (MIC). When the wireless terminal is in an operating mode, such as a recording mode or a voice recognition mode, the microphone is configured to receive an external audio signal. The received audio signal may be further stored in the memory. In some embodiments, the audio assembly may further include a loudspeaker configured to output the audio signal.

The I/O interface provides an interface for a processing assembly and a peripheral interface module, wherein the peripheral interface module may be a keyboard, a click wheel, a button, or the like. The button may include but not limited to a homepage button, a volume button, a start button and a lock button.

The sensor assembly includes one or more sensors and is configured to provide state evaluation of various aspects for the wireless terminal. For example, the sensor assembly may detect an on/off state of the terminal and relative positioning of the assemblies, for example, the assemblies are a display and a small keyboard of the terminal; and the sensor assembly may also detect position change of the terminal or one assembly of the terminal, contact or non-contact of the user and the terminal, the azimuth of the terminal or acceleration/deceleration, and temperature change of the terminal. The sensor assembly may include a proximity sensor and is configured to detect existence of nearby objects without any physical contact. The sensor assembly may further include a light sensor, such as a CMOS or CCD image sensor, and is applied to imaging application. In some embodiments, the sensor assembly may further include an acceleration sensor, a gyroscope sensor, a magnetic sensor, a pressure sensor, or a temperature sensor.

The communication assembly is configured to facilitate wire or wireless communication between the terminal and other devices. The wireless terminal may access a wireless network based on a communication standard, such as WiFi, 2G, or 3G, or a combination thereof. In an exemplary embodiment, the communication assembly receives a broadcast signal or broadcast related information from an external broadcast management system via a broadcast channel. In an exemplary embodiment, the communication assembly may further include a near-field communication (NFC) module to promote short-range communication. For example, the NFC module may be realized on the basis of a radio frequency identification (RFID) technology, an infrared data association (IrDA) technology, an ultrawide band (UWB) technology, a Bluetooth (BT) technology and other technologies.

The above descriptions are merely the optional embodiments of the present disclosure, but the protection scope of the present disclosure is not limited to these embodiments. Any variations or substitutions, which those skilled in the art would readily envisage within the technical scope disclosed by the present disclosure, should be covered within the protection scope of the present disclosure. Therefore, the protection scope of the present disclosure should be subject to the appended claims.

What is claimed is:

1. An antenna assembly, comprising:

a metal frame, wherein a first partition gap and a second partition gap are spacedly arranged on the metal frame, and the metal frame positioned between the first partition gap and the second partition gap forms a first radiator; and a radio frequency module, wherein the radio frequency module is coupled to the first radiator by a radio frequency signal feeder;

wherein the metal frame between the first partition gap and the second partition gap is provided with a first ground point;

the antenna assembly is applied in a wireless terminal which comprises: a display assembly and a support frame, wherein an accommodating space is formed in the support frame, the accommodating space being configured to mount the display assembly, and the metal frame is coupled to a first frame of the support frame;

wherein a second ground point is arranged on the first frame and coupled to the first ground point by a ground wire.

2. The antenna assembly according to claim 1, wherein the first partition gap and the second partition gap are both filled with an insulating material.

3. The antenna assembly according to claim 1, further comprising:

a second radiator, wherein the first radiator is coupled to the radio frequency signal feeder by the second radiator.

4. The antenna assembly according to claim 3, wherein a width range of the second radiator is 1 mm to 2 mm.

5. The antenna assembly according to claim 1, wherein the first ground point and the radio frequency signal feeder are separated by a first preset distance.

6. The antenna assembly according to claim 1, wherein the radio frequency signal feeder is a shielded wire.

7. A wireless terminal, comprising:

an antenna assembly, the antenna assembly comprising: a metal frame, wherein a first partition gap and a second partition gap are spacedly arranged on the metal frame, and the metal frame positioned between the first partition gap and the second partition gap forms a first radiator; and a radio frequency module, the radio frequency module being coupled to the first radiator by a radio frequency signal feeder, wherein the metal frame between the first partition gap and the second partition gap is provided with a first ground point;

a display assembly;

a support frame, wherein an accommodating space is formed in the support frame, the accommodating space being configured to mount the display assembly, and the metal frame is coupled to a first frame of the support frame; and a processor, configured to acquire a display content by the antenna assembly and control the display assembly to display the display content;

wherein a second ground point is arranged on the first frame and coupled to the first ground point by a ground wire.

8. The wireless terminal according to claim 7, wherein the support frame comprises a metal support frame and a plastic support frame which are integrally molded, wherein the plastic support frame is configured to support the display assembly.

9. The wireless terminal according to claim 8, wherein the support frame is manufactured by a nanometer injection molding process.

10. The wireless terminal according to claim 8, wherein a circuit board is arranged in the accommodating space, and the processor and the radio frequency module are both arranged on the circuit board; and the metal support frame is coupled to a third ground point of the circuit board by a conductive material.

11. The wireless terminal according to claim 10, wherein the display assembly comprises a first display screen and a second display screen which are opposite to each other;

wherein the circuit board is arranged between the first display screen and the second display screen.

12. The wireless terminal according to claim 11, wherein a metal protective layer is arranged between the first display screen and the second display screen, and coupled to both the third ground point of the circuit board and the conductive material.

13. The wireless terminal according to claim 12, wherein the metal protective layer and the metal support frame are coupled by a plurality of conductive materials, and the plurality of conductive materials are spacedly arranged.

14. The wireless terminal according to claim 10, wherein the conductive material is a conductive sponge.

15. The wireless terminal according to claim 7, wherein the metal frame is semicircular, and the metal frame and the support frame are integrally molded.

16. The wireless assembly according to claim 7, wherein the first partition gap and the second partition gap are both filled with an insulating material.

17. The wireless terminal according to claim 7, wherein the antenna assembly further comprises:

a second radiator, wherein the first radiator is coupled to the radio frequency signal feeder by the second radiator.

18. The wireless terminal according to claim 7, wherein a minimum distance between the first radiator and the first frame of the support frame is greater than 5 mm.

19. The wireless terminal according to claim 7, wherein the metal frame and the support frame form a hanging ring.

20. A wireless terminal, comprising:

an antenna assembly, the antenna assembly comprising: a metal frame, wherein a first partition gap and a second partition gap are spacedly arranged on the metal frame, and the metal frame positioned between the first partition gap and the second partition gap forms a first radiator; and a radio frequency module, the radio frequency module being coupled to the first radiator by a radio frequency signal feeder, wherein the metal frame between the first partition gap and the second partition gap is provided with a first ground point;

a display assembly; and a support frame, wherein an accommodating space is formed in the support frame, the accommodating space being configured to mount the display assembly, and the metal frame is coupled to a first frame of the support frame;

wherein a second ground point is arranged on the first frame and coupled to the first ground point by a ground wire.

* * * * *